United States Patent [19]

Cumming et al.

[11] Patent Number: 4,834,297

[45] Date of Patent: May 30, 1989

[54] AIR AND ION SUPPLY VIA DISPENSING NOZZLE

[75] Inventors: Newell E. Cumming; James H. Sidell, both of Encino, Calif.

[73] Assignee: Cumming Corporation, Chatsworth, Calif.

[21] Appl. No.: 49,925

[22] Filed: May 15, 1987

[51] Int. Cl.[4] ..... H01T 23/00

[52] U.S. Cl. ..... 239/690; 239/525; 239/600; 361/231

[58] Field of Search ..... 239/690, 3, DIG. 27, 239/704–707, 526, 600, 525, 530; 361/228, 230

[56] References Cited

U.S. PATENT DOCUMENTS

| | | | |
|---|---|---|---|
| 2,018,434 | 10/1935 | Ballentine | 361/231 |
| 3,422,263 | 1/1969 | Asahina | 361/231 |
| 3,711,743 | 1/1973 | Bolasny | 361/231 |
| 4,083,077 | 4/1978 | Knight et al. | 285/276 |
| 4,124,164 | 11/1978 | Bachman | 239/DIG. 22 |
| 4,194,232 | 3/1980 | Cumming et al. | 361/213 |
| 4,219,864 | 8/1980 | Grunenfelder et al. | 239/704 |
| 4,496,375 | 1/1985 | Le Vantine | 55/131 |
| 4,508,276 | 4/1985 | Malcolm | 239/691 |

FOREIGN PATENT DOCUMENTS

| | | | |
|---|---|---|---|
| 1281602 | 10/1968 | Fed. Rep. of Germany | 361/231 |
| 1912703 | 3/1969 | Fed. Rep. of Germany | 239/704 |
| 865763 | 4/1961 | United Kingdom | 239/708 |
| 1436024 | 6/1974 | United Kingdom | 239/690 |

OTHER PUBLICATIONS

"The Dust Destroyers", Cumming Corporation Sales Brochure, Aereon.

*Primary Examiner*—Duane A. Reger
*Assistant Examiner*—Kevin P. Weldon
*Attorney, Agent, or Firm*—William W. Haefliger

[57] ABSTRACT

The nozzle has gooseneck shape and defines a gooseneck hollow elongated interior passage within head and neck portions of the nozzle, the air, high voltage and control lines entering the passage at the end of the neck portion, the high voltage and compressed air lines extending together lengthwise in the hollow and terminating in the head portion of the nozzle, the nozzle having an elongated body including a removable plate having gooseneck shape and extending at a concave side defined by the body, the plate bridging the head and neck portions to provide access to the major length of the passage and to ion dispensing tips when the plate is removed.

4 Claims, 1 Drawing Sheet

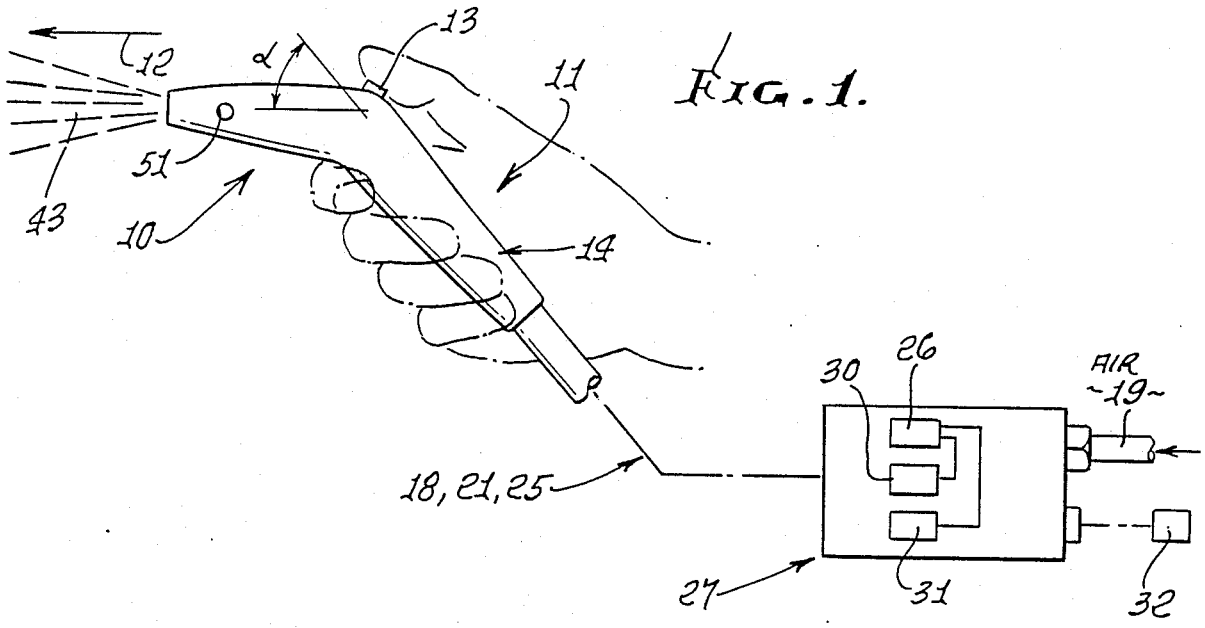
FIG. 1.
FIG. 3.
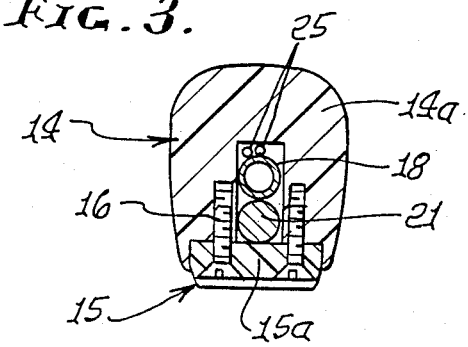
FIG. 2.
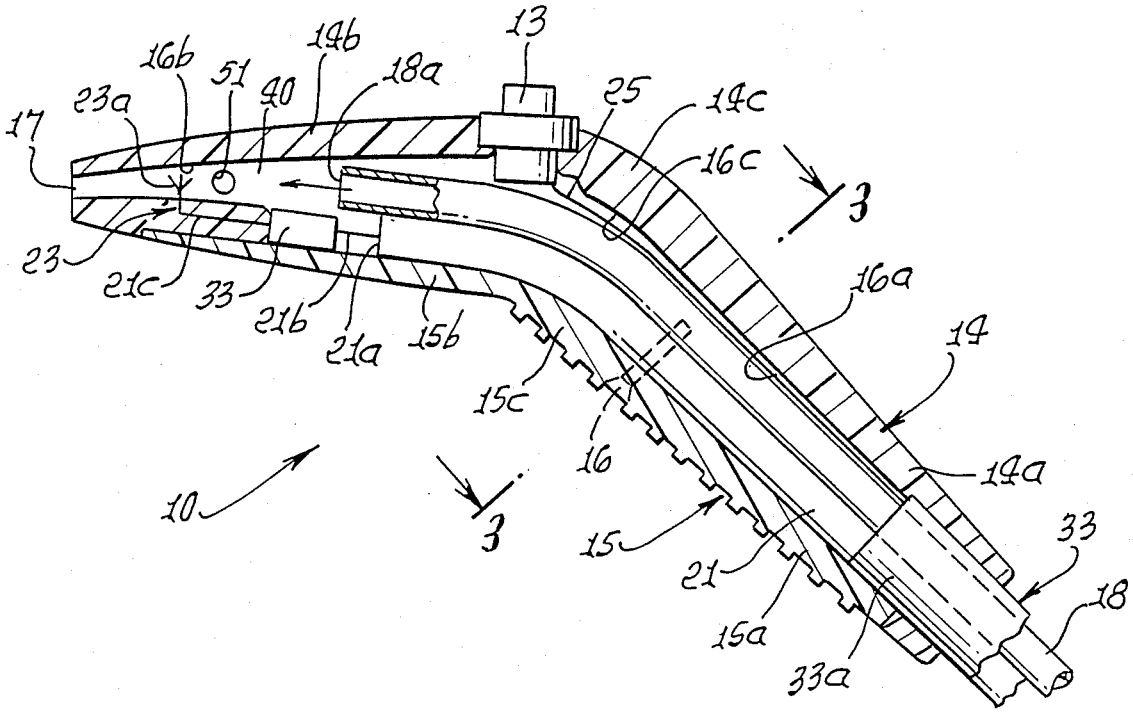

AIR AND ION SUPPLY VIA DISPENSING NOZZLE

BACKGROUND OF THE INVENTION

This invention relates generally to directed application of ions, for cleansing and static neutralization of surfaces; and more particularly concerns provision of graspable means to accomplish such directed application.

There is need for means that is easily graspable to effect directed ion application to surfaces and zones, as for example in product production where surfaces of parts must be neutralized or maintained at a selected state charge level, positive or negative.

SUMMARY OF THE INVENTION

It is a major object of the invention to provide an improved, superior hand graspable device meeting the above needs. Basically, the device of the invention comprises:

(a) parallel elongated flexible lines, a nozzle at one end of the lines, and a base at the other end of said lines, the nozzle having an outlet, (b) said lines including (i) a compressed air line connected to a source of compressed air and communicating with said outlet, (ii) a high voltage line extending from a high voltage source to ion dispensing tip means exposed to air flow from said source to said outlet, and (iii) a control line extending from a control at the base to a switch manually operable to cause said control to effect air delivery to the nozzle and to cause high voltage application to said tip means.

As will appear, the tip means may include multiple fine wire ends located in an air passage defined by the nozzle; an additional line may be provided in the form of a flexible protective duct containing the above referenced lines; and the air line also terminates at the passage in the nozzle, upstream from the fine wires so that ions are swept forward off the fine wires and in the air discharge from the nozzle.

Further, the nozzle advantageously has gooseneck shape, and includes a hollow body with a gooseneck base plate that is removable to provide access to the hollow including the air passage and a safety control resistance, for cleaning and repair.

These and other objects and advantages of the invention, as well as the details of an illustrative embodiment, will be more fully understood from the following specification and drawings, in which:

DRAWING DESCRIPTION

FIG. 1 is a diagramatic view showing use of apparatus incorporating the invention;

FIG. 2 is a vertical section through such apparatus; and

FIG. 3 is a section on lines 3—3 of FIG. 2.

DETAILED DESCRIPTION

In FIGS. 1 and 2, a nozzle 10 is hand held at 11 to dispense ions in the direction of arrow 12, when a control button 13 is pressed, as by the user's thumb. The nozzle includes a body 14 having gooseneck shape, i.e. including a straight hand grip portion 14*a*, a straight and forwardly convergent dispensing end portion 14*b*, and a curved position 14*c* connecting portions 14*a* and 14*b*.

The angle $\alpha$ between the axes of portions 14*a* and 14*b*, is between 30° and 60°, and preferably about 40°.

Body 14 also includes a removable cover plate 15 at its underside, and retained to the body upper extent as by a fastener 16. Plate 15 also has elongated gooseneck shape, with portion 15*a* connected to body portion 14*a*, portion 15*b* connected to body portion 15*b*, and mid-portion 15*c* that turns through angle $\alpha$. Plate 15 is removable to give access to the body interior, for cleaning dirt and dust therefrom.

The body interior is hollow, and includes extents 16*a*–16*c* located in corresponding body portions 14*a*–14*c*. Hollow extent 16*a* is forwardly and upwardly divergent; hollow extent 16*b* is forwardly convergent, and hollow extent 16*c* turns through angle $\alpha$, and has the largest cross section. Nozzle outlet 17 is at the forward end of hollow 16*b*.

Parallel elongated flexible lines are provided, and include:

(i) a compressed air line 18 connected to a source 19 of compressed air, and extends in hollows 16*a*–16*c* to discharge at 18*a* toward outlet 17;

(ii) a high voltage line or cable 21 extending from a high voltage source 31 to ion dispensing tip means 23 typically including multiple fine wire tips 23*a* located in passage 40 (formed by hollow 16*b*, and exposed to compressed air flow from discharge 18*a* toward outlet 17; and (iii) a control line or lines 25 extending from the control switch 13 on the nozzle to a control 26 at a base 27, the switch being manually operable to cause the control 26 to effect compressed air delivery to the nozzle and to cause high voltage application to the tips 23*a*. Note the operative connection of control 26 with a valve 30 that controls air flow to line 18, and with a switch 31 that controls high voltage application from a source 32 to line or cable 21. Line 25 may be a low voltage line, i.e. 12.5 volts.

The lines 18, 21 and 25 are shown as contained by a fourth line such as a sheath or duct 33 which is flexible and protective. It extends from the end of the nozzle at 33*a* to the base 27.

Note that cable 21 terminates at 21*a*, and wire 21*b* extends from the cable to connect with a protective resistor 33 at one side of passage 40. The opposite end of the resistor is connected at 21*a* with the tips 23*a*.

In operation, when the control button 13 is pushed inward, the control circuit is completed, to cause high voltage application (−3,000 VDC to −22,000 VDC) and preferably about −4,300 VDC to the tips 23*a*; also compressed air is delivered via line 18 to the passage 40, to sweep over the exposed tips 23*a* carrying ions forwardly in the discharge at 43, seen in FIG. 1. Positive voltage application can be employed. Manual grasping of the gooseneck nozzle facilitates directed discharge of ions wherever desired, for cleaning dust off surfaces and neutralizing them at the same time. In this regard, high AC voltage may be applied to the tips, if desired; or positive DC voltage of a selected level may be applied. Control 31 may be adjusted for these purposes.

Also incorporated in the nozzle are two air holes 51, at opposite sides of the nozzle. They serve to significantly lower the operating noise level, and also to increase the air discharge from the nozzle, by aspiration effect. Also, these side holes act as a safety pressure release should the tip of the nozzle become clogged.

The air pressure regulator may be inside or outside the power supply base 27.

Fastener 16 may be removed and the plate or cover 15 can then be snap-connected in place, as an alternate attachment.

We claim:

1. In apparatus to selectively and locally supply ions to a target area, (a) parallel elongated flexible lines, a nozzle at one end of the lines, and a base at the other end of said lines, the nozzle having an inlet end and an outlet, (b) said lines including:

(i) a compressed air line connected to a source of compressed air and communicating with said outlet, (ii) a high voltage line extending from a high voltage source to ion dispensing tip means exposed to air flow from said source to said outlet, (iii) a control line extending from a control at the base to a switch at the nozzle, the switch manually operable to cause said control to effect air delivery to the nozzle and to cause high voltage application to said tip means, (iv) and a flexible protector duct enclosing said air line, said high voltage line, and said control line, (c) the nozzle having gooseneck shape and defining a gooseneck hollow elongated interior passage within head and neck portions of the nozzle, said air line, high voltage line and control line entering said passage at the end of the neck portion, and within said duct, said high voltage and compressed air lines extending together lengthwise in said hollow and terminating in said head portion of the nozzle, (d) the nozzle having an elongated body including a removable plate having gooseneck shape and extending at a concave side defined by the body, the plate bridging said head and neck portions to provide access to the major length of the passage and to said tip means when the plate is removed, the plate also having gooseneck shape and extending along substantially the entire length of the nozzle, (e) said tip means including tips located at the nozzle and directly exposed to air discharging from said compressed air line, the nozzle having an outlet from said passage downstream of said tip means, the plate overlapping the tip means, (f) the body also defining an outer convex side, the switch located at said outer convex side, (g) said flexible duct extending into said nozzle body, and said air line, high voltage line and control line extending from said duct to be exposed when the gooseneck plate is removed.

2. The apparatus of claim 1 wherein said tip means includes multiple tips located at the nozzle.

3. The apparatus of claim 1 including a resistor at one side of said passage, and connected in series with said tip means.

4. The apparatus of claim 1 including side hole means in the nozzle upstream from the nozzle outlet to pass air between the exterior and interior of the nozzle.

* * * * *